United States Patent [19]

Tucker

[11] 3,963,318

[45] June 15, 1976

[54] CONTACT AND CONTACT ASSEMBLY

[75] Inventor: Council A. Tucker, Los Angeles, Calif.

[73] Assignee: American Telecommunications, El Monte, Calif.

[22] Filed: Oct. 28, 1975

[21] Appl. No.: 626,130

Related U.S. Application Data

[63] Continuation of Ser. No. 443,496, Feb. 19, 1974, abandoned, which is a continuation-in-part of Ser. No. 312,609, Dec. 6, 1972, Pat. No. 3,842,395.

[52] U.S. Cl. ..... 339/97 P

[51] Int. Cl.[2] ..... H01R 9/08

[58] Field of Search ..... 339/97 R, 97 C, 97 P, 339/98, 99 R, 174, 258 R, 258 P; 29/203 J, 203 P, 203 H, 203 HM, 203 HC, 628, 629, 630 R, 630 A

[56] References Cited

UNITED STATES PATENTS

| | | | |
|---|---|---|---|
| 2,877,441 | 3/1959 | Narozny | 339/258 R |
| 2,969,521 | 1/1961 | Scoville | 339/258 R |
| 3,012,219 | 12/1961 | Levin et al. | 339/98 |
| 3,112,147 | 11/1963 | Pferd et al. | 339/97 R |
| 3,234,498 | 2/1966 | Logan | 339/97 R |
| 3,394,454 | 7/1968 | Logan | 339/97 P |
| 3,434,094 | 3/1969 | Walter | 339/258 R |
| 3,503,036 | 3/1970 | Desso et al. | 339/258 R |
| 3,521,221 | 7/1970 | Lenaerts et al. | 339/97 F |
| 3,594,712 | 7/1971 | Enright et al. | 339/97 R X |
| 3,617,983 | 11/1971 | Patton | 339/98 |
| 3,715,450 | 2/1973 | Martin | 339/98 X |
| 3,723,948 | 3/1973 | Wyatt et al. | 339/99 R |
| 3,761,868 | 9/1973 | Krone et al. | 339/98 |
| 3,761,869 | 9/1973 | Hardesty et al. | 339/99 R |
| 3,926,498 | 12/1975 | Hoppe | 339/97 R |

*Primary Examiner*—Roy Lake
*Assistant Examiner*—Craig R. Feinberg
*Attorney, Agent, or Firm*—Christie, Parker & Hale

[57] ABSTRACT

Each subassembly of a contact assembly has a group of contacts which are flat. Each of these contacts has a pair of upstanding blades symmetrical about a vertical axis which define a mouth for gripping and holding a lead, an enlarged passage for the free receipt of the lead passing from the mouth, converging edges of this passage for stripping insulation from the lead, and a coining slot defined by parallel edges for coining the conductive element of the lead and effecting good electrical contact and a mechanical interlock of the lead with the contact. Each blade has a stiffening rib extending laterally away from the plane of the contact to define an overall contact thickness essentially the same as the thickness of the throat of a standard lead installation tool. Each contact subassembly has an offset, flexible wiper for electrical engagement with a conductor of a male plug.

9 Claims, 5 Drawing Figures

CONTACT AND CONTACT ASSEMBLY

CROSS-REFERENCE TO RELATED APPLICATION

The present application is a continuation application of application Ser. No. 443,496, filed Feb. 19, 1974, now abandoned, which in turn was a continuation-in-part of application Ser. No. 312,609, filed Dec. 6, 1972, now U.S. Pat. No. 3,842,395.

BACKGROUND OF THE INVENTION

The present invention relates in general to the art of electrical connections and, more in particular, to a contact assembly for effecting electrical connection with standard electrical leads without the necessity of solder.

Contacts are used to make an electrical connection between desired circuit elements. The type of contacts of interest here is for a permanent connection and is used as a convenience in making an electrical circuit. In this application, an insulated lead having a conductor element is used with the contact.

Solderless contacts are well known and are used extensively. A well-known type of this contact has a pair of legs which define a slot between them. A mouth with converging sides opens into this slot and receives a lead. As the lead is forced down the slot the legs spread apart, the insulation of the lead engaged by the edges of the slot is stripped, and the edges come into electrical contact with the conductor element of the lead for an electrical connection. A mechanical lock between the conductor element and the contact arises from elastic deformation of the legs during lead insertion producing a compressive force between the legs and the conductor element. In at least one known contact, the legs actually coin the conductor element to groove it and effect mechanical interference between the lead and the contact in the direction of the length of the contact.

This type of contact is also used extensively in multiple connections. In multiple connections, several leads are wired to contacts at one time. It is extremely convenient if there is some means for firmly retaining a lead with a contact before final installation, so that wiring changes can be made when an error in an array is most likely to be noted and before final lead trimming and insulation removal.

With this type of contact, a standard installation tool has come into widespread use. The tool is used to force a lead into electrical connection with a contact and to cut off the end of the lead. This installation tool has a throat for receiving the contact. The throat has two parallel walls which, in use, parallel the plane of the contact. One of these walls is longer than the other and has a cutting edge parallel with the wall at its bottom. The cutting edge is about in the middle of its wall so as to space an actual cut from the most proximate contact surface. The shortness of the opposite parallel wall of the tool avoids excessive compression by it on a lead during the cutting process.

A most effective way of making contacts of this sort is by a punching process where the various edges and geometries are physically sheared from a metal strip by a punch press. There are known limits to this process, however. When an object to be punched becomes too thick relative to the width of slots and the like to be defined, punching is not possible.

A contact should be relatively strong so that it can take the abuse of the installation process and inadvertent forces it might receive. The strength requirements are at odds with the punch fabrication requirements for slotting to receive lead sizes commonly used, for to effect the punching operation, and yet have slot widths properly dimensioned to effect the stripping of insulation from the conductor element, the contact cannot be thick enough to be as strong as would be desired.

One use of the contact is in a jack for making a plurality of electrical connections with a plug. Typically, the plug has rigid, electrically conductive blades for connection to the contacts. Often it is required that the connection be extremely good to avoid, for example, electrical noise. This is complicated in a plug and a jack because the two are often disconnected and reconnected which can affect the quality of the connection. To get a good connection it is necessary to have the jack contacts which engage the plug blades elastically flexible to produce compressive engagement between them.

SUMMARY OF THE INVENTION

In one form the present invention contemplates a contact structure having a pair of upstanding opposed blades. These blades extend from an integral connection with a base. The base is adapted to be anchored in a jack. The blades are adapted to be free-standing above a surface of the jack for accepting and making an electrical connection with a standard electrical lead. The blades and base are generally flat and thin with the front and rear surfaces thereof generally parallel, with each such surface falling in a common plane. Hence the contacts are planar except for ribs present in a preferred embodiment. The blades have opposing edges which define from top to bottom a mouth having a width sufficiently narrow to compressively hold the insulation of a standard lead without damaging a conductor element thereof. An enlarged passage opens into the mouth and has at its bottom end converging edges which are sized to strip or cut insulation material from a lead and bare a conductor element for subsequent electrical engagement with the contact. A coining slot below the passage opens into the passage at its bottom end. The coining slot has a width sufficiently narrow to coin a conductor of a standard lead and effect good electrical connection therewith, and a mechanical interlock perpendicular to the plane of the contact and along the conductor.

Preferably, the contact has a pair of ribs, one for each blade and both on the same side of the contacts. The ribs flank the mouth, passage and coining slot, and, preferably, are generally parallel thereto. The thickness of the contact measured from an external face of the ribs to a side of the contacts opposite the face is substantially the same as the throat thickness of the standard lead installation tool.

The present invention also contemplates a contact subassembly having contacts of the type just described and further including a contact wiper element. The wiper contact has a wiper head which is generally planar. The head is connected to a shank preferably through a reentry bend such that the plane of the head departs from parallelism with the other contacts by an acute angle. The shank extends generally from bottom to top of the planar contacts and also laterally outward with respect to these contacts. A connecting section extending laterally from the contacts connects the contacts and the shank. The thickness and width of the connecting section and shank are less than the wiper head.

The present invention also contemplates a contact assembly which includes a plurality of the contacts just described and joined by frangible zones which are readily broken for separating individual contact subassemblies.

Features of the present invention include in a contact subassembly the provision of a depending U-shaped section connected to the base of the planar contacts and from which the connecting section of the wiper contact extends. This depending U-shaped section effects a deeper contact dimension and imparts considerable flexibility to the shank and connecting section of the wiper contact by virtue of the greater length it imparts to the two in aggregate. Strikes or other means in the structure of the contacts may effect an anchor between the contacts and a jack used with it.

These and other features, aspects and advantages of the present invention will become more apparent from the following description, appended claims and drawings.

DESCRIPTION OF THE PREFERRED EMBODIMENT

Figure 1:
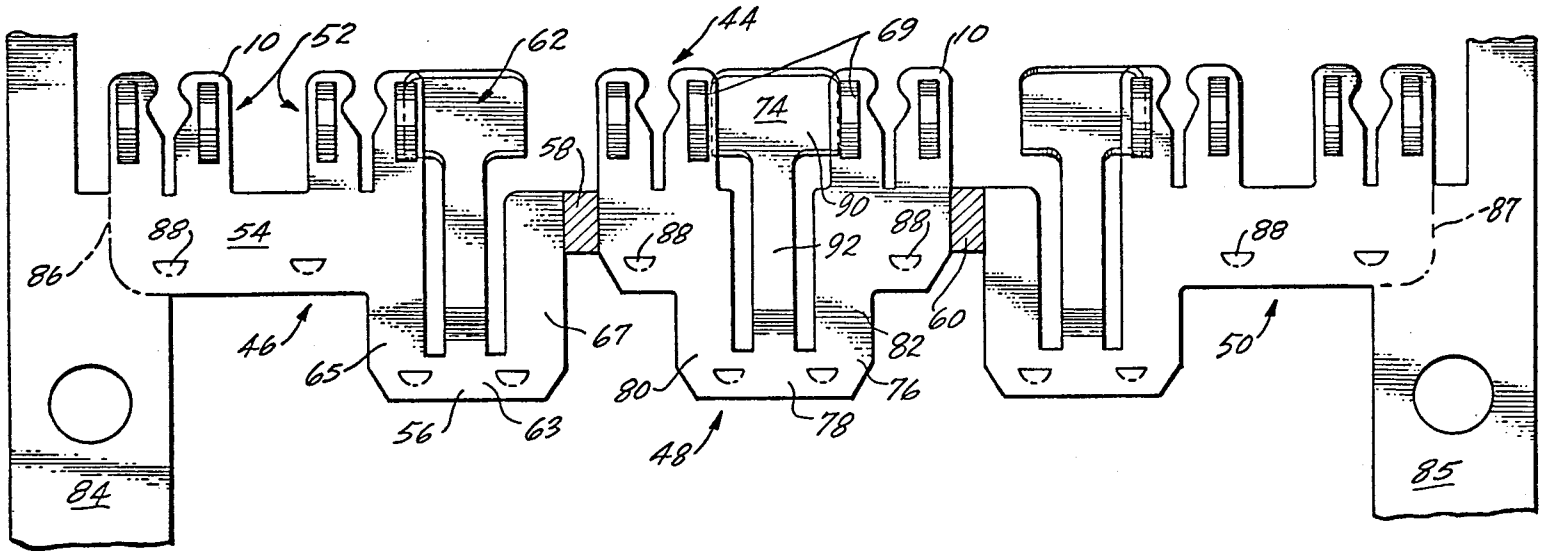
FIG. 1 is a front elevational view of a contact assembly in accordance with the preferred embodiment of the present invention.
Figure 2:
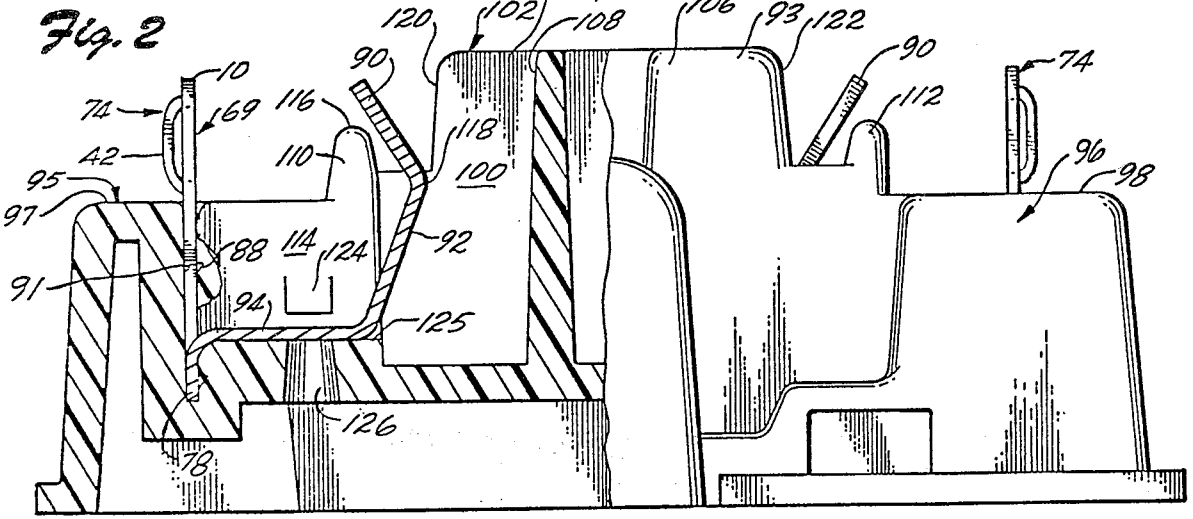
FIG. 2 is an end elevational view, partly in section, of the contact assembly of FIG. 1 in a jack.
Figure 5:
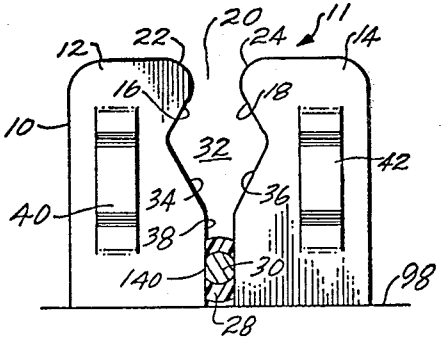
FIG. 5 is a frontal elevation of the contact of the previous Figures showing a lead in electrical contact therewith and mechanically locked thereto.

With initial reference to FIGS. 1, 2 and 5, the contact assembly, contact subassembly, and individual contacts of the present invention are illustrated. An individual contact is shown at 10.

Figure 3:
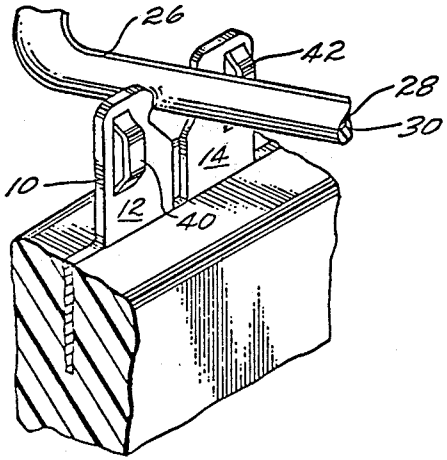
FIG. 3 is a perspective view of a single contact of the contact assembly of the first two Figures holdng a lead prior to final wiring of assembly and dress.

With particular reference to FIG. 5, each contact includes a head 11 comprised of two upstanding blades 12 and 14. The blades have opposing edges 16 and 18 which define a mouth 20. These edges are symmetrical about an imaginary vertical line drawn between them. The edges at the entrance to this mouth are rounded at 22 and 24. The minimum width of the mouth is sized, as seen in FIG. 3, slightly smaller than the outside diameter of a lead 26 to pinch and hold insulation 28 of the lead prior to the finalization of a connection between the lead and contact. The minimum width of the mouth, however, is larger than the diameter of a conductor 30 of the lead. The mouth edges are rounded to facilitate the placement of the lead into the mouth.

The mouth opens into a passage 32, which at its widest is larger than the outside diameter of the lead. Passage 32, however, has converging edges 34 and 36 which funnel the lead into a coining slot 38. The direction of convergence is away from the mouth and towards the coining slot. Each of the converging edges is straight and, as will subsequently appear, cut insulation from the lead prior to the lead's entrance into the coining slot. The convergence forces stripped insulation toward the mouth and away from the bared conductor so that the latter can make clean electrical contact with the contact in the coining slot. The symmetry of the edges about the imaginary vertical line results in a lead being accurately centered between the edges preliminarily to coining.

Coining slot 38 has a width smaller than the diameter of conductor 30. Conductor 30 is coined where it contacts the edges of the slot when it is forced into the slot to a width less than its original diameter to effect a mechanical lock between the contact and the lead in the direction of the lead's length.

Because the lead is centered by the converging edges 34 and 36 prior to entry into the coining slot, subsequent coining takes an essentially equal amount of conductor material from each side of the conductor. The result is that the conductor has remaining a larger area of material to resist stress than would be the case if coining took more material from one side of the conductor than from the other.

Blades 12 and 14 also have vertically extending ribs 40 and 42 to stiffen the blades, thicken them so that the blades essentially completely occupy the throat width of a standard installation tool, and to space the terminated end of a lead away from a crevice between a contact mount of a jack and the contact, all of which will become more apparent as this description proceeds. The ribs flank the mouth passage and coining slot and lie on the same side of the contact. As can be seen from the Figures, the ribs extend at least directly to the side of the junction of the coining slot and enlarged passage 32 above it.

As seen in FIG. 1, contact 10 is a part of a larger monolithic contact assembly strip 44 which has a plurality of contacts identical to the one just described in detail. The assembly is divided into three contact subassemblies 46, 48 and 50.

Subassemblies 46 and 50 are symmetrical to each other about an imaginary vertical line between them and thus a description of one will suffice for both. Subassembly 46 has a contact pair 52 constituted of individual of contacts 10. The contacts of this pair are joined by a common horizontal base 54. A U-shaped section 56 depends from base 54 and joins contact subassembly 48 through a weakened or frangible zone 58. The latter is removed during assembly of the contact strip in a jack, and with the removal contact subassemblies 46 and 48 separate from each other. An identical weakened or frangible zone 60 on the opposite symmetrical side facilitates the separation of contact subassemblies 48 and 50.

Contact subassembly 46 has a wiper contact 62 which is connected to a horizontal bight 63 of U-shaped section 56. U-shaped section 56 also has vertical legs 65 and 67. Leg 65 joins base 54 and leg 67 joins weakened zone 58. Leg 67 is the longer of the two.

Subassembly 48 connects subassemblies 46 and 50 through the aforementioned zones of weakness 58 and 60. It differs from the other subassemblies in that it has a pair of contacts 69 constituted of two of contacts 10 which are symmetrically disposed about an imaginary line bisecting a wiper contact 74 of the subassembly, whereas the wiper contacts of subassemblies 46 and 50 are to one side of their contact pairs. The function of base 54 in connecting contacts 10 of subassembly 46 is performed by a U-shaped section 76, from which wiper contact 74 extends. U-shaped section 76 is symmetrical about the same wiper contact bisecting line, but U-shaped section 56 is not symmetrical about an imaginary line bisecting wiper contact 62 in that legs 65 and 67 are not of equal length. U-shaped section 76 has a horizontal bight 78 from which a pair of vertical legs 80 and 82 extend.

Contact strip assembly 44 has on each side a carrier strip 84 and 85. These carrier strips are broken away during the assembly of the contacts in a jack. A weakened area for this purpose is shown by the phantom lines at 86 and 87 for the carrier strips 84 and 85, respectively. Each of the contact subassemblies has a plurality of strikes 88 to anchor it in a plastic jack.

With reference to both FIGS. 1 and 2, the wiper contact of each contact subassembly will be more completely described. All of the wiper contacts are identical and therefore this description will be limited to wiper contact 74. This wiper contact includes a wiper head 90, a shank 92 and a horizontal connecting section 94. The shank extends vertically and also laterally away from the plane of the balance of contact pair 69 of the subassembly. Wiper head 90 caps the shank and bends back towards the plane of the contact pair. The shank and horizontal connecting sections are relatively thin and narrow in comparison to the length of the wiper contact to allow the wiper contact to flex and twist in accommodation of a conductor blade of a plug used with the jack.

With reference to FIG. 2 specifically, the disposition of a contact subassembly in a jack 93 is illustrated in some detail. The jack components are symmetrical about an imaginary vertical bisecting plane perpendicular to the plane of the Figure. When suitable for clarity, symmetrical components have the same reference numerals. Jack 93 has a pair of longitudinally extending contact mounts 95 and 96 for receiving the contact subassemblies. Each contact mount has a longitudinally extending slot 91 for the receipt of each contact subassembly. Each slot is shallower or greater in depth to accommodate the difference in height of the contact subassemblies occasioned by the depending of the U-shaped sections, such as U-shaped section 76. Strikes 88 of each of the subassemblies bight into the material of the jack, which is plastic, to anchor the subassembly to the jack. The outboard side of each contact mount has a cutting surface against which leads are trimmed to size by a cutting implement. The cutting surfaces are shown at 97 and 98 for mounts 95 and 96, respectively. The wiper contact of each contact subassembly is received in a pocket 100 of a stab receptacle 102. Each pocket has upstanding pocket defining walls. Of these, walls 104 and 106 extend laterally of the longitudinal axis of the jack and define the limits of longitudinal excursions of the blade of a plug and the wiper contact. An inner wall 108 of the upstanding walls defines the limit of travel for the plug blade laterally towards the longitudinal centerline of the jack. A pair of outer lateral guide walls 110 and 112 are split by a transverse passage 114 through which horizontal connecting section 94 of the wiper contact extends from the plane of contact pair 69. These lateral guide walls are capped by stops 116 which are positioned to engage the back side of wiper head 90 and thereby limit the amount of laterally outward deformation it can undertake in response to accommodating a blade of a plug.

Lateral walls 104 and 106 have steps 120 and 122 which limit the forward travel of the wiper heads and which are relatively high to bear against the inner surface of a cover used with the jack. Transverse passage 114 has a pair of tabs 124 which limit vertical deflection of horizontal connecting section 94 of the wiper contact. A floor 125 is in close proximity to horizontal section 94 and limits its downward deflection. A core hole 126 allows the pulling of the mold core which defines the undercut of the tabs.

With reference to all of the Figures, the use of the contact structure of the present invention will be described.

When it is time to assemble a jack, the carrier strips are manually broken away and the contact subassemblies separated from each other by manually breaking them apart at the frangible zones between them. The subassemblies are then placed in appropriate longitudinal slots of the jack.

When it is time to wire a jack, leads are arranged in what is believed to be the correct array by inserting each lead into the desired mouth of contacts 10. After this is done, the array can readily be checked before final installation. Thus, in FIG. 3 a lead is captured in the mouth defined by blades 12 and 14 by its insulation being compressed or pinched between them. When an installer is satisfied that an array is correct, a standard installation tool 130 is used to complete the task. The tool has a throat 132 to receive a contact, a rear wall 134 to bear on a lead, and a front wall 136 terminating in a cutting edge 138. The cutting edge is below the end of wall 134. The tool is placed successively over each contact and forced down to force the lead to the contact down and to establish electrical communication between the contact and the conductor of the lead. Progressively the tool forces the lead into enlarged passage 32 where the lead initially meets no resistance until it engages funnel defining edges 34 and 36. Here, with continued forcing of the lead towards coining slot 38, insulation is cut from the lead and the conductor of the lead bared. Typically, insulation is removed only where actually cut by the funnel edges. Thus, protective insulation remains between the cut and the end of the lead closest to the cut. The removed insulation is forced upwardly away from the bared conductor by the converging edges of passage 32. The lead at the bottom of passage 32 is centered with respect to coining slot 38 because of the symmetry of the piloting and insulation stripping edges 34 and 36. As the lead is forced into coining slot 38, conductor 30 coins. With coining, a mechanical interlock arises between the conductor and the contact in the direction of the line of the lead. This interlock prevents lead movement when pulled or pushed through the slot. Stated differently, the interlock comes from a neck formed in the conductor by the coining, the neck being shown at 140 in FIG. 5. Because of the centered position of the lead entering the coining slot, coining will take place equally on both sides of the conductor of the lead. This reduces the likelihood of lead failure by conductor failure in the coining slot over conductors asymmetrically coined. This is so because in asymmetrical coining less conductor material remains after coining in the coining slot than with symmetrical coining, at least with round conductors.

With the coining, cutting edge 138 of tool 130 cuts through insulation and conductor material to trim an end 141 off the lead. Cutting surface 98 of contact mount 96 prevents lead movement and resists the cutting edge during trimming.

Figure 4:
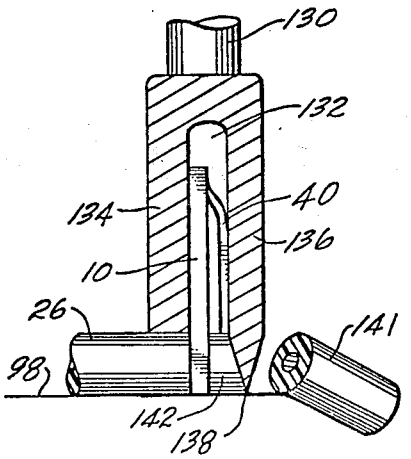
FIG. 4 is an elevational fragmentary view, partly in section, of the dressing of a lead with a standard lead installing tool, with the lead and contact of the previous Figures already electrically connected and mechanically locked.

As seen in FIG. 4, ribs 40 and 42 force cutting tool 130 away from the plane of the contact to leave a small extending section 142 of the conductor also extending away from the plane of the contact. Thus there is plenty of room to effect a proper necking of the conductor and the mechanical interlock. This spacing by the ribs also keeps cutting edge 138 away from the crevice existing at the entrance of longitudinal slot 91. Ribs 40 and 42 also stiffen the contact for bending and torsional strength. Importantly, the contact can be made relatively thin elsewhere so that the coining slot, enlarged passage and mouth can all be fabricated by shearing. If the contact had a continuous thickness, as thick as the dimension between the face of the ribs and the back wall of the contact, it would not be possible to readily fabricate the cutting slot by shearing with the dimensions it must have to be effective with standard leads. This is so because the required width of the coining slot would be too small relative to the thickness of the contact to be fabricated by shearing. Another function of the rib is to limit "horseshoeing" of the lead during installation. As can be appreciated, with a standard installation tool having the throat thickness shown, no effective proximation of the throat walls with the contact would be possible. Accordingly, in this space a lead could excessively horseshoe by bending into an inverted deep "U". This would be totally unsatisfactory because there would be no effective electrical connection with the contact and any such connection would likely be fragile and easily broken.

The present invention has been described with reference to a certain preferred embodiment. The spirit and scope of the appended claims should not, however, necessarily be limited to the foregoing description.

What is claimed is:

1. An improved contact structure comprising:

a. a generally planar, vertical base;

b. a pair of upstanding, vertical blades extending from the base and in the same plane therewith;

c. the blades defining between them a mouth proximate the top of the blades, an enlarged passage below the mouth and opening into the mouth, and a coining slot below the enlarged passage and opening into the passage, the mouth having a width to compressively engage and hold a lead without damage to a conductor thereof, the enlarged passage having a pair of straight edges which converge towards and terminate at the coining slot, the converging edges being sized to strip insulation contacted by the edges from a lead, the coining slot having generally parallel and spaced apart edges and being sized to coin a conductor of a lead to effect therewith good electrical contact and a mechanical interference lock in a direction perpendicular to the length of the slot and along the axis of the lead, the enlarged passage and coining slot being symmetrical about a vertical line of symmetry; and d. a pair of thickening ribs for the blades, one rib being on each blade, and both ribs being on the same side of the blades, the external lateral limit of each of the ribs being defined by a face, the thickness of the contact from the face of each rib to the surface of the contact on the side thereof opposite the ribs being substantially the width of the throat of a standard lead installation tool, the ribs being spaced on either side of the mouth, passage and coining slot, and the ribs extending vertically and directly to the sides of the coining slot at least adjacent the meeting of the enlarged passage and the coining slot.

2. The improved contact structure claimed in claim 1 wherein the blades define between them opposed edges above the mouth which gradually converge and merge into the mouth to facilitate placement of a lead therein.

3. The improved contact structure claimed in claim 1 wherein the mouth, enlarged passage, and coining slot are shear-formed.

4. The improved contact structure claimed in claim 3 wherein the mouth, enlarged passage, and coining slot are shear formed and the opposed edges extend above the mouth and gradually diverge away from the mouth to facilitate placement of a lead into the mouth.

5. An improved contact subassembly comprising:

a. a pair of connected planar contacts, each contact having a pair of upstanding, vertical blades defining between them opposed edges:

i. the top of the opposed edges defining a mouth having a minimum width to interfere with the insulation of a standard lead without damage to a conductor of the lead;

ii. an enlarged passage joining the mouth and being disposed below the mouth, the passage having edges converging away from the mouth, the converging edges being to cut insulation from a lead and bare a conductor of the lead, the converging edges also being to center the bare conductor on a vertical line of symmetry;

iii. a coining slot below the passage and joining the passage at the end of the converging edges opposite the mouth, the coining slot having generally parallel edges and having a width sufficiently small to coin a conductor of a standard lead;

iv. the converging edges of the enlarged passage and the edges of the coining slot being symmetrical about the vertical line of symmetry; and b. a pair of ribs for each of the planar contacts, one rib of each pair being on one blade of the associated contact and the other rib of the pair being on the other blade of the associated contact, each rib extending vertically and being directly to one side of the coining slot of the associated contact at the junction thereof with the enlarged passage, each rib having a face which parallels the plane of the associated contact, each face defining a maximum contact thickness measured from the face to the surface of the contact opposite the rib which is substantially equal to the width of the throat of a standard lead installation tool.

6. The improved contact structure subassembly claimed in claim 5 including a wiper contact having a wiper head disposed laterally to one side of the plane of the contacts, a shank extending from the head generally parallel to the plane of the contacts, and a connecting section connecting the shank and the contacts and extending generally perpendicular to the plane of the contacts.

7. The improved contact structure subassembly claimed in claim 5 including a wiper contact having a wiper head, a shank and a connecting section, the connecting section being attached to the planar contacts below the blades thereof and extending laterally therefrom, a shank connected to the connecting section and extending upwardly from the connecting section and laterally away from the plane of the contacts, a generally planar wiper head for engaging a rigid conductor element of a plug having a width greater than the shank or the connecting section, and a reentry bend connecting the wiper head with the shank such that the plane of the wiper head extends upwardly and laterally towards the plane of planar contacts.

8. An improved contact assembly comprising:

a. at least two planar contacts, each having:

i. a pair of upstanding blades defining between them opposed edges;

ii. the top of the opposed edges defining a mouth having a width at its narrowest dimension sized to compressively engage the insulation of a standard lead without affecting a conductor of the lead;

iii. an enlarged passage opening into the mouth at the bottom thereof, the passage having generally straight edges converging towards the bottom thereof sized to cut insulation from a standard lead and bare a conductor thereof;

iv. a coining slot opening into the passage at the bottom thereof, the coining slot having a width sized to coin a conductor of a standard lead; and v. a free-standing rib on each blade adjacent the mouth, passage and coining slot and having a thickness together with the blade substantially the same as the throat thickness of a standard lead installation tool;

b. a conductive base rigidly securing the planar contacts together and lying in the same plane therewith;

c. a U-shaped section depending from the base and having a bight at the bottom thereof; and d. a wiper contact having:

i. a connecting section joined to the bight of the U-shaped section and extending laterally therefrom;

ii. a shank joined to the end of the connecting section opposite the bight and extending upwardly and laterally away from the planar contacts; and iii. a wiper head for engaging a rigid, conductive element of a plug joined to the shank through a reentry bend to dispose the lead generally upright and laterally toward the planar contacts.

9. The improved contact assembly claimed in claim 8 including a plurality of strikes on the assembly for embedding in plastic of a jack to anchor the assembly to the jack.

* * * * *